US006775580B2

(12) United States Patent
Jira et al.

(10) Patent No.: US 6,775,580 B2
(45) Date of Patent: Aug. 10, 2004

(54) INTERACTIVE REAL TIME COMPUTER PROCESSED GOLF TOURNAMENT SYSTEM

(75) Inventors: Thomas J. Jira, Lady Lake, FL (US); Clyde H. Boyer, Concord, OH (US)

(73) Assignee: Gyro Golf Systems, Inc., Euclid, OH (US)

( * ) Notice: Subject to any disclaimer, the term of this patent is extended or adjusted under 35 U.S.C. 154(b) by 111 days.

(21) Appl. No.: 09/999,693

(22) Filed: Oct. 24, 2001

(65) Prior Publication Data

US 2002/0087222 A1 Jul. 4, 2002

Related U.S. Application Data

(60) Provisional application No. 60/242,782, filed on Oct. 24, 2000.

(51) Int. Cl.[7] ..... G06F 155/00

(52) U.S. Cl. ..... 700/92; 700/90; 700/91; 700/93; 473/131; 463/1; 463/2; 463/40; 463/41; 463/42

(58) Field of Search ..... 700/90–93; 473/131, 473/407, 409; 463/1–3, 40–42

(56) References Cited

U.S. PATENT DOCUMENTS 3,771,792 A * 11/1973 Crumlish ..... 273/245
4,546,982 A * 10/1985 Gaines et al. ..... 273/298
5,332,218 A * 7/1994 Lucey ..... 463/18
5,779,242 A * 7/1998 Kaufmann ..... 273/459
5,779,566 A * 7/1998 Wilens ..... 473/407
6,047,967 A * 4/2000 Murphy et al. ..... 273/245
6,159,098 A * 12/2000 Slomiany et al. ..... 463/25
6,193,610 B1 * 2/2001 Junkin ..... 463/40
6,209,870 B1 * 4/2001 Shea et al. ..... 273/146
6,224,486 B1 * 5/2001 Walker et al. ..... 463/42
6,375,568 B1 * 4/2002 Roffman et al. ..... 463/26
6,402,614 B1 * 6/2002 Schneier et al. ..... 463/17
6,468,155 B1 * 10/2002 Zucker et al. ..... 463/23
6,508,710 B1 * 1/2003 Paravia et al. ..... 463/42

OTHER PUBLICATIONS

IGN Staff: EA Plays with the Pros, Oct.1999, http://pc.ign.com/articles/071/071230p1.html.*
IGN: Tiger Woods PGA Tour 2000, Jan. 2000, http://pocket.ign.com/objects/012/012093.html?ui=gamefinder.*

* cited by examiner

*Primary Examiner*—Teresa Walberg
*Assistant Examiner*—Christina M. Marks
(74) *Attorney, Agent, or Firm*—Fay, Sharpe, Fagan, Minnich & McKee LLP

(57) ABSTRACT

A method for playing an interactive computer processed golf tournament in real time via the Internet. The method includes the steps of registering users via the Internet and storing the user name, address, age, telephone, credit card data and club number on a library file. The method includes scheduling named tournaments, registering users via the Internet as contestants in one of the named tournaments including, assigning the user a position within a flight of a first round of the named tournament, and storing the assigned position on the library file. Participating contestant logins are accepted via the Internet prior to each named tournament. Participating contestants are provided with a scorecard display for the assigned flight including a tournament name, a countdown clock, one or more contestant scores, a cursor, and a message area. User inputs are accepted in real time via the Internet from each of the participating contestants in turn for each of the holes wherein each input determines a random score for the hole. A winner of each of the flights is determined based on a total of the random scores. Each winner is assigned to a position in a successive flight in a successive round and the process is repeated until the last championship round. Playing a championship round includes determining a plurality of championship round winners based on the random scores and awarding prizes to the championship round winners.

4 Claims, 19 Drawing Sheets

TOURNMENT SCORECARD DISPLAY FORMAT

30

32

TOURNAMENT NAME

| 88 | 34 FLIGHT NUMBER | 36 POSITION | 38 IDENTIFICATION NUMBER | 40 CONTESTANT INFORMATION |
|---|---|---|---|---|
| MODULE 1 | 1 | 1 | 530 - 6691 | NAME, ADDRESS, ETC. |
| | | 2 | 261 - 5633 | " |
| | | 3 | 433 - 7288 | " |
| | | 4 | 402 - 2267 | " |
| | | 5 | 202 - 8338 | " |
| | | 6 | 438 - 4004 | " |
| | | 7 | 692 - 9627 | " |
| | | 8 | 737 - 8321 | " |
| | | 9 | 491 - 5506 | " |
| | | 10 | 886 - 7839 | " |
| MODULE 2 | 2 | 1 | 551 - 1188 | " |
| | | 2 | 302 - 1275 | " |
| | | 3 | 296 - 5303 | " |
| | | 4 | 431 - 6927 | " |
| | | 5 | 878 - 5335 | " |
| | | 6 | 607 - 8761 | " |
| | | 7 | 193 - 1377 | " |
| | | 8 | 171 - 2021 | " |
| | | 9 | 691 - 3156 | " |
| | | 10 | 266 - 3338 | " |
| | 3 | 1 | 339 - 2122 | " |
| | | 2 | 775 - 1099 | " |
| | | 3 | 484 - 3005 | " |
| | | 4 | 266 - 2118 | |
| | | | ETC. | |
| | | | | " |
| MODULE 1,000 | 1,000 | 5 | 123 - 1177 | " |
| | | 6 | 456 - 8662 | " |
| | | 7 | 789 - 5757 | " |
| | | 8 | 987 - 3091 | " |
| | | 9 | 654 - 6244 | " |
| | | 10 | 321 - 9095 | " |

TOURNAMENT REGISTRATION / LIBRARY FILE / RECORD STRUCTURE

FIG. 2

TOURNMENT SCORECARD DISPLAY FORMAT

60

WELCOME TO THE INTERACTIVE GOLF TOURNAMENT NETWORK (INTERGOLF). NATIONWIDE GOLF TOURNAMENTS ARE HELD EVERY WEEK ON SUNDAY AT 4 PM EST. EACH TOURNAMENT IS LIMITED TO 10,000 CONTESTANTS AND CONSISTS OF FOUR ROUNDS. ALL ROUNDS WILL BE COMPLETED IN APPROXIMATELY ONE HOUR. ALL CONTESTANTS HAVE AN EQUAL CHANCE OF WINNING. THE ENTRY FEE IS $20.00. A PORTION OF THIS FEE WILL BE DONATED TO A CHARITY DETERMINED BY THE TOURNAMENT MANAGEMENT. A DONATION WILL BE MADE TO A DIFFERENT CHARITY EACH WEEK. CASH PRIZES ARE AWARDED FOR THE TOP FOUR FINISHING PLACES. THE TOTAL PRIZE AMOUNT MAY VARY FROM TOURNAMENT TO TOURNAMENT BUT IS NORMALLY $50,000.00. IF YOU ARE INTERESTED IN RECEIVING FREE INFORMATION ON ENTRY INSTRUCTIONS AND THE TOURNAMENT BEING HELD THIS WEEK, PLEASE CLICK ON THE BOX BELOW OR EXIT THE WEBSITE.

☐ YES, I WANT TO RECEIVE FREE TOURNAMENT INFORMATION

☐ I WISH TO EXIT THE WEBSITE

INITIAL GREETING MESSAGE

FIG. 4

62

THIS WEEKS TOURNAMENT IS SPONSORED BY THE NATIONWIDE SUPPLY COMPANY, THE LEADING SUPPLIER OF CONSUMER GOODS IN THE UNITED STATES.

THE PRIZE MONEY FOR THIS TOURNAMENT IS $50,000.00 AND WILL BE PAID AS FOLLOWS: FIRST PLACE $25,000.00; SECOND PLACE $15,000.00; THIRD PLACE $7,000.00; AND FOURTH PLACE $3,000.00. FOUR TOURNAMENT ROUNDS WILL BE PLAYED. EACH OF THE FIRST THREE ROUNDS WILL CONSIST OF FLIGHTS OF 10 PLAYERS PER FLIGHT. FLIGHT WINNERS ADVANCE TO THE NEXT ROUND. THE FOURTH AND LAST ROUND IS THE CHAMPIONSHIP ROUND AND WILL CONSIST OF THE 10 WINNERS FROM ROUND THREE. IN THE CHAMPIONSHIP ROUND, THE FOUR LOWEST SCORES WILL RECEIVE A PRIZE. A SUDDEN DEATH PLAYOFF WILL BE HELD ONLY FOR A FIRST PLACE TIE. TIES FOR THE OTHER TOP POSITIONS WILL SHARE THE PRIZE MONEY. (FOR EXAMPLE, A TWO-WAY TIE FOR THIRD PLACE WILL SHARE THE THIRD AND FOURTH PLACE PRIZE MONEY, I.E. $5,000.00 PER PERSON).

DURING THE TOURNAMENT, EACH PERSON WILL RECEIVE A SCORE FOR EACH HOLE AS FOLLOWS: FOR PAR 3 HOLES, ANY NUMBER FROM 1 TO 6; FOR PAR 4 HOLES, ANY NUMBER FROM 2 TO 7; AND FOR PAR 5 HOLES, ANY NUMBER FROM 3 TO 8. THE SCORE IS DETERMINED BY A COMPUTERIZED RANDOM NUMBER SIGNAL GENERATOR LOCATED IN THE INTERACTIVE GOLF TOURNAMENT SYSTEM. THE METHOD IS THE SAME AS IF THE PERSON WAS ROLLING A SET OF SPECIAL DICE. ONE PER HOLE. A GAME LIKE THIS IS AVAILABLE AND IS CALLED "ROLL-A-ROUND" WHICH CAN BE ORDERED SEPARATELY. SEE ORDERING INSTRUCTIONS AT THE END OF THIS MESSAGE.

IN ORDER TO ENTER THE TOURNAMENT, PLEASE CLICK ON THE BOX BELOW AND ENTER THE INFORMATION IN THE PLACES BELOW.

☐ YES, I WANT TO ENTER THE TOURNAMENT.

CLUB NUMBER _____

IF YOU WANT TO ORDER THE GOLF DICE GAME "ROLL-A-ROUND", PLEASE CLICK ON THE BOX BELOW.

☐ YES, I WANT TO ORDER "ROLL-A-ROUND"

YOU WILL BE BILLED A TOTAL OF $8,00 FOR THE GAME WHICH INCLUDES SHIPPING AND HANDLING.

ALL PERSONAL INFORMATION WILL BE HELD IN THE STRICTEST CONFIDENCE AND WILL NOT BE GIVEN TO ANY OUTSIDE SOURCE. IF YOU ORDERED "ROLL-A-ROUND", IT WILL BE SHIPPED WITHIN 10 DAYS WITH A MONEY BACK GUARANTEE.

TOURNMENT ENTRY INSTRUCTIONS

FIG. 5

☐ SORRY, YOUR ENTRY CANNOT BE ACCEPTED BECAUSE THE TOURNAMENT IS FILLED. YOU HAVE BEEN PUT ON "STANDBY" AND MAY BE ENTERED IF THERE ARE ANY CANCELLATIONS. PLEASE LOG ON THE DAY OF THE TOURNAMENT AT LEAST ONE HOUR PRIOR TO TOURNAMENT TIME TO SEE IF THERE ARE ANY OPENINGS. YOU MAY BE ABLE TO ENTER AT THAT TIME.

☐ SORRY, YOUR ENTRY CANNOT BE ACCEPTED BECAUSE YOUR CREDIT CARD HAS BEEN REJECTED.

☐ SORRY, YOUR ENTRY CANNOT BE ACCEPTED BECAUSE SOME INFORMATION YOU ENTERED IS INCORRECT. PLEASE CHECK ALL INFORMATION AND CORRECT ANY ERRORS.

☐ THE INFORMATION YOU HAVE SUBMITTED HAS BEEN VALIDATED AND YOU HAVE BEEN ENTERED IN THE TOURNAMENT. PLEASE STAY ON LINE FOR FURTHER INFORMATION. 64

REGISTRATION VAIDATION MESSAGE

FIG. 6

1. CONGRATULATIONS! YOU HAVE ENTERED A NATIONWIDE INTERACTIVE GOLF TOURNMENT WHICH WE KNOW YOU WILL ENJOY. 66

2. YOU MUST LOG ON THE SYSTEM ON THE DAY OF THE TOURNAMENT AT LEAST 15 MINUTES PRIOR TO THE STARTING TIME (4 PM EST). YOU MUST USE THE SAME LOCATION TELEPHONE NUMBER TO LOG ON AS YOU USED TO ENTER THE TOURNAMENT. THE ENTRY TELEPHONE NUMBER IS YOUR IDENTIFICATION (ID) NUMBER.

3. CLICK ON THE BOX BELOW TO RECEIVE TOURNAMENT INFORMATION DOWNLOADED TO YOUR PRINTER.

☐ YES, I WANT TO RECEIVE INFORMATION SENT TO MY PRINTER.

4. IF YOU WANT TO CANCEL YOUR ENTRY, YOU MUST DO SO AT LEAST 24 HOURS PRIOR TO TOURNAMENT TIME. OTHERWISE, YOU WILL BE ENTERED AND BILLED THE ENTRANCE FEE. INSTEAD OF CANCELLING, YOU MAY WANT TO SELECT A PERSON TO PLAY THE GAME ON YOUR BEHALF USING YOUR COMPUTER SITE.

TOURNMENT OPERATIONAL INSTRUCTIONS

FIG. 7

1. YOUR STATUS IS:

☐ YOUR LOG ON HAS BEEN VALIDATED AND YOU HAVE BEEN ENTERED INTO A 10 PERSON FLIGHT IN ROUND NUMBER 1. 68

☐ YOU ARE CURRENTLY ON "STANDBY" AND THERE ARE NO OPENINGS.

☐ YOU ARE CURRENTLY ON STANDBY AND THERE ARE SEVERAL OPENINGS AVAILABLE. IF YOU WANT TO ENTER THE TOURNAMENT, PLEASE CLICK ON THE BOX BELOW:

☐ YES, I WANT TO ENTER THE TOURNAMENT.

2. THE COMPLETE TOURNAMENT CONSISTS OF FOUR ROUNDS. YOU MUST WIN THE FIRST THREE ROUNDS TO COMPETE IN THE CHAMPIONSHIP ROUND.

3. WHEN THE SCORECARD APPEARS ON YOUR SCREEN, YOUR ID NUMBER IN THE PLAYER COLUMN IS YOUR 7-DIGIT TELEPHONE NUMBER. THIS ID NUMBER WILL BE USED THROUGHOUT THE TOURNAMENT.

4. TOURNAMENT SPECIFIC MESSAGES WILL APPEAR PERIODICALLY BELOW THE SCORECARD.

5. WHEN THE PROMPT (YELLOW CURSOR ARROW) APPEARS NEXT TO YOUR ID NUMBER, YOU WILL HAVE 3 SECONDS TO DEPRESS THE "ENTER" KEY ON YOUR COMPUTER. IF YOU DO NOT DEPRESS THIS KEY WITHIN 3 SECONDS, YOU WILL RECEIVE THE HIGHEST SCORE POSSIBLE FOR THE HOLE BEING PLAYED.

6. YOU WILL BE "LOCKED OUT" OF THE "ENTER" FUNCTION WHEN THE YELLOW PROMPT ARROW IS NOT NEXT TO YOUR ID NUMBER. YOU ARE TO DEPRESS THE ENTER KEY <u>ONLY</u> WHEN THE PROMPT APPEARS NEXT TO YOUR ID NUMBER.

7. WHEN YOU HAVE READ THESE MESSAGES, DEPRESS THE ENTER KEY TO OBTAIN YOUR SCORECARD DISPLAY ON YOUR SCREEN.

TOURNMENT DAY STATUS / INSTRUCTIONS

FIG. 8

TIME TO START 00:53 (72)

NATIONWIDE SUPPLY COMPANY TOURNMENT

ROUND 1 FLIGHT 1

PLAYER TURN

| PLAYER IDENTIFICATION / HOLE NUMBER | 1 | 2 | 3 | 4 | 5 | 6 | 7 | 8 | 9 | OUT TOTAL 36 | 10 | 11 | 12 | 13 | 14 | 15 | 16 | 17 | 18 | IN TOTAL 36 | TOTAL 72 |
|---|---|---|---|---|---|---|---|---|---|---|---|---|---|---|---|---|---|---|---|---|---|
| PAR | 4 | 5 | 4 | 3 | 4 | 4 | 5 | 3 | 4 | | 4 | 3 | 4 | 4 | 5 | 4 | 3 | 4 | 5 | | |
| ABLE | | | | | | | | | | | | | | | | | | | | | |
| BARKER | | | | | | | | | | | | | | | | | | | | | |
| CHARLIE | | | | | | | | | | | | | | | | | | | | | |
| DAVE | | | | | | | | | | | | | | | | | | | | | |
| ELI | | | | | | | | | | | | | | | | | | | | | |
| FRANK | | | | | | | | | | | | | | | | | | | | | |
| GOMEZ | | | | | | | | | | | | | | | | | | | | | |
| HARRY | | | | | | | | | | | | | | | | | | | | | |
| ISAAC | | | | | | | | | | | | | | | | | | | | | |
| JOE | | | | | | | | | | | | | | | | | | | | | |

(70)

1. THE TOURNMENT WILL START WHEN THE COUNTDOWN CLOCK (TIME TO START) IN THE UPPER LEFT CORNER REACHES 00:00.
2. THE YELLOW CURSOR WILL APPEAR NEXT TO A PLAYERS IDENTIFICATION NUMBER FROM TOP TO BOTTOM. WHEN IT APPEARS, THE PLAYER HAS 3 SECONDS TO DEPRESS THE ENTER KEY ON HIS/HER PERSONAL COMPUTER. ALL OTHER PLAYERS ARE LOCKED OUT.IF A PLAYER DOES NOT DEPRESS THE ENTER KEY WITHIN THE 3 SECOND TIME PERIOD, HE/SHE WILL RECEIVE THE MAXIMUM NUMBER OF STROKES FOR THE HOLE BEING PLAYED.
3. AT THE END OF THE ROUND, THE WINNER WILL BE HIGHLIGHTED AND ALL OTHER PLAYERS WILL BE DISCONNECTED. THE WINNER WILL RECEIVE INSTRUCTIONS FOR CONTINUING TO THE NEXT ROUND. IN THE CASE OF TIES, TIEBREAKING INSTRUCTIONS WILL BE GIVEN AT THE END OF THE ROUND.

TYPICAL TOURNMENT MESSAGES

FIG. 9

TIME TO START 00:00

NATIONWIDE SUPPLY COMPANY TOURNMENT

ROUND 1 FLIGHT 1

PLAYER TURN

ENTER

| HOLE NUMBER / PLAYER IDENTIFICATION / PAR | 1 | 2 | 3 | 4 | 5 | 6 | 7 | 8 | 9 | OUT TOTAL 36 | 10 | 11 | 12 | 13 | 14 | 15 | 16 | 17 | 18 | IN TOTAL 36 | TOTAL 72 |
|---|---|---|---|---|---|---|---|---|---|---|---|---|---|---|---|---|---|---|---|---|---|
| PAR | 4 | 5 | 4 | 3 | 4 | 4 | 5 | 3 | 4 | | 4 | 3 | 4 | 4 | 5 | 4 | 3 | 4 | 5 | | |
| ABLE 74 | 3 | | | | | | | | | | | | | | | | | | | | |
| BARKER | | | | | | | | | | | | | | | | | | | | | |
| CHARLIE | | | | | | | | | | | | | | | | | | | | | |
| DAVE | | | | | | | | | | | | | | | | | | | | | |
| ELI | | | | | | | | | | | | | | | | | | | | | |
| FRANK | | | | | | | | | | | | | | | | | | | | | |
| GOMEZ | | | | | | | | | | | | | | | | | | | | | |
| HARRY | | | | | | | | | | | | | | | | | | | | | |
| ISAAC | | | | | | | | | | | | | | | | | | | | | |
| JOE | | | | | | | | | | | | | | | | | | | | | |

1. THE TOURNMENT WILL START WHEN THE COUNTDOWN CLOCK (TIME TO START) IN THE UPPER LEFT CORNER REACHES 00:00.
2. THE YELLOW CURSOR WILL APPEAR NEXT TO A PLAYERS IDENTIFICATION NUMBER FROM TOP TO BOTTOM. WHEN IT APPEARS, THE PLAYER HAS 3 SECONDS TO DEPRESS THE ENTER KEY ON HIS/HER PERSONAL COMPUTER. ALL OTHER PLAYERS ARE LOCKED OUT.IF A PLAYER DOES NOT DEPRESS THE ENTER KEY WITHIN THE 3 SECOND TIME PERIOD, HE/SHE WILL RECEIVE THE MAXIMUM NUMBER OF SRTOKES FOR THE HOLE BEING PLAYED.
3. AT THE END OF THE ROUND, THE WINNER WILL BE HIGHLIGHTED AND ALL OTHER PLAYERS WILL BE DISCONNECTED. THE WINNER WILL RECEIVE INSTRUCTIONS FOR CONTINUING TO THE NEXT ROUND. IN THE CASE OF TIES, TIEBREAKING INSTRUCTIONS WILL BE GIVEN AT THE END OF THE ROUND.

EXAMPLE OF FIRST PLAYER SCORE AND DISPLAY HIGHLIGHTING

FIG. 10

TIME TO START 00:00

NATIONWIDE SUPPLY COMPANY TOURNMENT

ROUND 1 FLIGHT 1

PLAYER TURN

WINNER

| PLAYER IDENTIFICATION / HOLE NUMBER / PAR | 1 | 2 | 3 | 4 | 5 | 6 | 7 | 8 | 9 | OUT TOTAL 36 | 10 | 11 | 12 | 13 | 14 | 15 | 16 | 17 | 18 | IN TOTAL 36 | TOTAL 72 |
|---|---|---|---|---|---|---|---|---|---|---|---|---|---|---|---|---|---|---|---|---|---|
| PAR | 4 | 5 | 4 | 3 | 4 | 4 | 5 | 3 | 4 | | 4 | 3 | 4 | 4 | 5 | 4 | 3 | 4 | 5 | | |
| ABLE | 3 | 7 | 6 | 3 | 3 | 7 | 8 | 1 | 2 | 40 | 4 | 2 | 6 | 5 | 7 | 2 | 3 | 6 | 7 | 42 | 82 |
| BARKER | 2 | 8 | 4 | 4 | 4 | 3 | 4 | 4 | 6 | 39 | 3 | 4 | 5 | 4 | 6 | 3 | 1 | 3 | 6 | 35 | 74 |
| CHARLIE | 5 | 8 | 3 | 1 | 7 | 2 | 5 | 3 | 3 | 37 | 2 | 5 | 4 | 6 | 8 | 4 | 3 | 6 | 5 | 43 | 80 |
| DAVE | 6 | 5 | 7 | 2 | 4 | 6 | 7 | 1 | 4 | 42 | 5 | 3 | 2 | 3 | 6 | 5 | 2 | 3 | 4 | 33 | 75 |
| ELI | 6 | 4 | 6 | 1 | 3 | 2 | 5 | 3 | 4 | 34 | 6 | 4 | 3 | 7 | 8 | 3 | 4 | 4 | 3 | 42 | 76 |
| FRANK | 4 | 5 | 7 | 6 | 5 | 4 | 6 | 5 | 5 | 47 | 7 | 1 | 3 | 5 | 3 | 3 | 6 | 2 | 4 | 34 | 81 |
| GOMEZ | 7 | 3 | 2 | 5 | 6 | 5 | 4 | 2 | 5 | 39 | 4 | 1 | 3 | 7 | 4 | 4 | 5 | 6 | 4 | 38 | 77 |
| HARRY | 5 | 6 | 4 | 3 | 7 | 6 | 5 | 2 | 5 | 47 | 5 | 3 | 5 | 6 | 6 | 6 | 3 | 3 | 3 | 40 | 87 |
| ISAAC | 2 | 6 | 5 | 3 | 7 | 6 | 5 | 6 | 3 | 43 | 7 | 4 | 2 | 3 | 6 | 3 | 4 | 4 | 3 | 36 | 79 |
| JOE | 3 | 4 | 6 | 1 | 2 | 4 | 8 | 4 | 2 | 34 | 7 | 6 | 2 | 4 | 8 | 4 | 5 | 2 | 4 | 42 | 76 |

1. THE WINNER IS THE PLAYER WITH THE LOWEST SCORE AND IS HIGHLIGHTED ON THE SCREEN. AT THIS TIME, ALL PLAYERS EXCEPT THE WINNER WILL BE REMOVED FROM THE DISPLAY AND DISCONNECTED FROM THE SYSTEM.
2. FOR THOSE PERSONS WHO DID NOT COME IN FIRST PLACE, WE HOPE YOU ENJOYED THE GAME AND WILL ENTER OUR NEXT TOURNAMENT. PLEASE ACCESS OUR WEBSITE ADDRESS ON ANY DAY MONDAY THROUGH SATURDAY FOR DETAILS ON OUR NEXT TOURNAMENT.
3. WE HOPE YOU WILL DO BUSINESS WITH OUR SPONSOR, THE NATIONWIDE SUPPLY COMPANY, AS IT WAS INSTRUMENTAL IN MAKING THIS TOURNAMENT POSSIBLE. THANK YOU AND GOOD LUCK IN THE NEXT TOURNAMENT. REMEMBER - ALL CONTESTANTS HAVE AN EQUAL CHANCE OF WINNING.

COMPLETED SCORECORD EXAMPLE

FIG. 11

TIME TO START 00:00

NATIONWIDE SUPPLY COMPANY TOURNMENT

ROUND 2 FLIGHT 1

PLAYER TURN

| PLAYER IDENTIFICATION / HOLE NUMBER | 1 | 2 | 3 | 4 | 5 | 6 | 7 | 8 | 9 | OUT TOTAL 36 | 10 | 11 | 12 | 13 | 14 | 15 | 16 | 17 | 18 | IN TOTAL 36 | TOTAL 72 |
|---|---|---|---|---|---|---|---|---|---|---|---|---|---|---|---|---|---|---|---|---|---|
| PAR | 4 | 5 | 4 | 3 | 4 | 4 | 5 | 3 | 4 | | 4 | 3 | 4 | 4 | 5 | 4 | 3 | 4 | 5 | | |
| | | | | | | | | | | | | | | | | | | | | | |
| BARKER | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |

76

1. AS SOON AS ALL FLIGHT WINNERS HAVE BEEN DETERMINED, NINE OTHERS WILL BE INCLUDED IN THE NEXT ROUND AS YOUR COMPETITORS.
2. WATCH THE DISPLAY. YOUR POSITION IN THE ROUND LINEUP MAY CHANGE. AS SOON AS ALL IDENTIFICATION NUMBERS HAVE BEEN ENTERED ON THE SCOREBOARD, THE COUNTDOWN CLOCK (TIME TO START) WILL BE ACTIVATED AT 03:00 ALLOWING THREE MINUTES BEFORE THE NEXT ROUND STARTS.
3. THE RULES FOR THIS ROUND ARE THE SAME AS THE PREVIOUS ROUND. GOOD LUCK

FLIGHT WINNER MESSAGE

FIG. 12

TIME TO START 00:00

NATIONWIDE SUPPLY COMPANY TOURNMENT

CHAMPIONSHIP ROUND

| | HOLE NUMBER / PLAYER IDENTIFICATION / PAR | 1 | 2 | 3 | 4 | 5 | 6 | 7 | 8 | 9 | OUT TOTAL | 10 | 11 | 12 | 13 | 14 | 15 | 16 | 17 | 18 | IN TOTAL | TOTAL |
|---|---|---|---|---|---|---|---|---|---|---|---|---|---|---|---|---|---|---|---|---|---|---|
| | PAR | 4 | 5 | 4 | 3 | 4 | 4 | 5 | 3 | 4 | 36 | 4 | 3 | 4 | 4 | 5 | 4 | 3 | 4 | 5 | 36 | 72 |
| | BOB | 7 | 4 | 5 | 2 | 5 | 4 | 4 | 1 | 3 | 36 | 5 | 5 | 5 | 6 | 3 | 3 | 1 | 4 | 7 | 39 | 75 |
| TIE TRD | SAM | 2 | 3 | 6 | 6 | 4 | 3 | 5 | 2 | 5 | 36 | 3 | 3 | 2 | 7 | 5 | 5 | 2 | 5 | 3 | 35 | 71 |
| TIE TRD | JERRY | 4 | 5 | 3 | 2 | 5 | 5 | 6 | 4 | 4 | 38 | 2 | 1 | 6 | 4 | 8 | 2 | 2 | 4 | 4 | 33 | 71 |
| | HENRY | 5 | 6 | 4 | 1 | 3 | 6 | 3 | 5 | 6 | 39 | 3 | 5 | 4 | 7 | 5 | 3 | 6 | 6 | 5 | 44 | 83 |
| 2 ND | TED | 4 | 8 | 2 | 2 | 7 | 2 | 5 | 2 | 3 | 35 | 3 | 3 | 6 | 2 | 5 | 6 | 2 | 4 | 4 | 36 | 70 |
| 1 ST | JIM | 6 | 4 | 3 | 5 | 4 | 7 | 4 | 3 | 2 | 38 | 4 | 4 | 3 | 5 | 3 | 4 | 1 | 4 | 3 | 31 | 69 |
| | BILL | 4 | 5 | 4 | 3 | 7 | 3 | 5 | 6 | 6 | 43 | 7 | 4 | 2 | 4 | 6 | 2 | 4 | 2 | 5 | 36 | 79 |
| | MARK | 3 | 5 | 2 | 4 | 7 | 4 | 8 | 3 | 5 | 41 | 5 | 4 | 5 | 2 | 7 | 4 | 2 | 5 | 4 | 38 | 79 |
| | MIKE | 5 | 4 | 4 | 4 | 3 | 7 | 6 | 4 | 4 | 41 | 4 | 1 | 6 | 3 | 4 | 4 | 3 | 2 | 4 | 31 | 72 |
| | JOHN | 6 | 7 | 5 | 1 | 3 | 5 | 5 | 2 | 7 | 41 | 3 | 6 | 2 | 3 | 3 | 4 | 5 | 3 | 5 | 34 | 75 |

1. THE TOTAL PRIZE AMOUNT FOR THIS TOURNMENT IS $50,000.00. THIS AMOUNT IS DIVEDED AS FOLLOWS:

| | |
|---|---|
| FIRST PLACE | $25,000.00 |
| SECOND PLACE | 15,000.00 |
| THRID PLACE | 7,000.00 |
| FOURTH PLACE | 3,000.00 |

SINCE THERE IS A TIE FOR THIRD PLACE, THE TWO THIRD PLACE FINALISTS WILL SHARE THE THIRD AND FOURTH PLACE PRIZES ($10,000,00) AND WILL RECEIVE $5,000.00 EACH.

2. ALL WINNERS WILL RECEIVE THEIR PRIZE WITHIN 10 DAYS AFTER THE DATE OF THE TOURNMENT.

3. WE HOPE THAT ALL CONTESTANTS ENJOYED THE CHAMPIONSHIP ROUND AND WE HOPE THAT YOU WILL DO BUSINESS WITH OUR SPONSOR OF THIS TOURNMENT, THE NATIONWIDE SUPPLY COMPANY. THANK YOU AND GOOD LUCK IN THE NEXT TOURNMENT. REMEMBER - ALL CONTESTANTS HAVE AN EQUAL CHANCE OF WINNING.

EXAMPLE OF CHAMPIONSHIP ROUND DISPLAY AT THE FINISH

FIG. 13

GOLF TOURNAMENT SYSTEM BLOCK DIAGRAM

FLIGHT MODULE CONFIGURATION

STATUS FUNCTIONS

TOURNAMENT SCORING FUNCTIONS

CHAMPIONSHIP ROUND FUNCTIONS

INTERACTIVE REAL TIME COMPUTER PROCESSED GOLF TOURNAMENT SYSTEM

This application claims benefit of 60/242,782 filed Oct. 24, 2000.

BRIEF DESCRIPTION OF THE INVENTION

In an exemplary embodiment of the present invention a method for playing an interactive computer processed golf tournament is provided. The method includes the steps of registering users via the Internet by receiving a user name, address, age, telephone and credit card data, verifying the user age is at least 21 years, validating the user's credit card data, providing the validated user with a unique club number, and storing the user name, address, age, telephone, credit card data and club number on a library file. The method includes scheduling named tournaments, registering users via the Internet as contestants in one of the named tournaments including, assigning the user a position within a flight of a first round of the named tournament, and storing the assigned position on the library file. Participating contestant logins are accepted via the Internet prior to each named tournament. Participating contestants are provided with a scorecard display for the assigned flight including a tournament name, a countdown clock, one or more contestant scores, a cursor, and a message area. User inputs are accepted in real time via the Internet from each of the participating contestants in turn for each of the holes wherein each input determines a random score for the hole. A winner of each of the flights is determined based on a total of the random scores. Each winner is assigned to a position in a successive flight in a successive round and the process is repeated until the last championship round. Playing a championship round includes determining a plurality of championship round winners based on the random scores and awarding prizes to the championship round winners.

BRIEF DESCRIPTION OF THE DRAWINGS

FIG. 2 shows the tournament registration library file record structure;

FIG. 4 is an exemplary initial greeting message;

FIG. 5 shows tournament entry instructions;

FIG. 6 is an exemplary registration validation message;

FIG. 7 shows exemplary tournament operational instructions;

FIG. 8 shows exemplary tournament day instructions;

FIG. 9 shows typical messages during tournament;

FIG. 10 is an example of a first player score and display highlighting;

FIG. 11 is a completed scorecard example;

FIG. 12 is an exemplary flight winner message;

FIG. 13 is an example of a championship round display;

DETAILED DESCRIPTION OF THE INVENTION

Introduction

Figure 1:
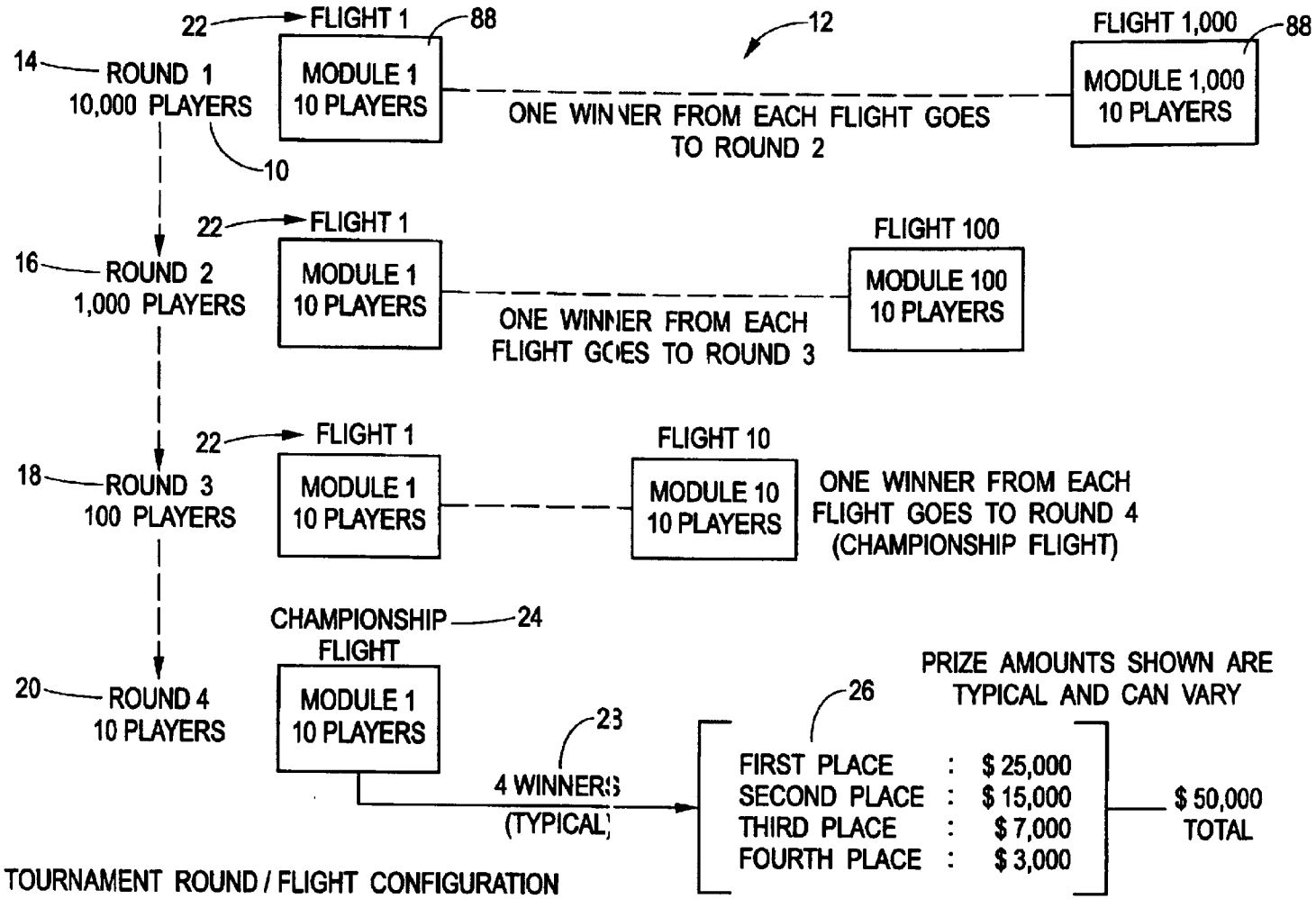
FIG. 1 shows tournament round and flight configuration.

Described herein are embodiments of an interactive (real time computer processed) golf tournament system by which golf tournaments are played nationwide by means of a golf tournament integrated "system" installed on a server computer and made available to the worldwide web (Internet). The "system" consists of integrated hardware and software installed at a particular site location which processes all tournament events from initial player tournament registration, collection of entrance fees, the determination of winners to the payment of prizes. The system is a turnkey operation and can be located at more than one site to handle more than one tournament simultaneously (for example, five different tournaments at the same time on the same day of the week). This would require a different website for each tournament. More than one website can be installed based on demand (number of registrants per tournament within a particular geographical area, i.e. continental U.S., Japan, etc.)

The system is self-contained and can be sold, installed and maintained on an international basis. However, in the continental United States, the preferred approach is to install and operate the system as a commercial venture by one company, however, partnerships with Internet companies (for example, AOL, Earthlink, etc.) are also possible to facilitate development, installation and operation of the system.

Each tournament will have a commercial sponsor who will provide the prize money ($50,000 minimum). In return, the sponsor will have the tournament named after the sponser (for example the "Wal-Mart Challenge") and will receive free advertising on the website during the duration of the tournament (from the time of initial registration through the end of the tournament, Monday through Sunday). In addition, the sponsor may, at its option, provide discounts to all tournament players. This is done by providing discount coupons to all entrants by either downloading them to the entrant's site for printing or by mail. If the sponsor is a retailer, this could provide additional sales and a means by which the prize money is recovered, either partially or fully.

Tournaments are arbitrarily limited to 10,000 players although the system is designed to handle more or less than this number of players. This number is a matter of convenience and economics (cost and expected profit). For example, if one tournament is held each week and the entrance fee is either $20.00 or $25.00 per contestant, the yearly revenue would be:

(52 Tournaments)×(10,000 Players)×($20 Fee)=$10,400,000.00

(52 Tournaments)×(10,000 Players)×($25 Fee)=$13,000,000.00

The system consists of the highest quality hardware and software available to minimize any downtime. An in-depth reliability, maintainability, availability (RMA) analysis is required to predict system failure rates and downtime. Since only one tournament is envisioned per week with an operating time of one hour maximum per tournament, this equates to only 52 operating hours per year per site for the complete system. The registration (sign-up) subsystem experiences more stress since it operates continuously until the registration file (library file) is complete for one tournament. However, since the subsystem is separate from the tournament playing subsystem, no difficulties are anticipated during the tournament. All subsystems are "burned in" prior to the initiation of tournament operations to identify faulty components. Usually, if a failure occurs, it occurs early in the operational life of a system. Any failures experienced during system 'burn in' should be analyzed for design deficiencies and design improvements made if required. System operational life is expected to be at least 25 years minimum.

Operational Processes and System Procedures

As shown in FIG. 1, the System is normally configured to accept up to 10,000 entrants (players) 10 nationwide per tournament 12. Each tournament 12 consists of four (4) rounds 14, 16, 18, 20, and each round consists of ten players per flight 22. Assuming that 10,000 players have entered a tournament, round one will consist of 1,000 flights of ten entrants; the flights are played simultaneously. After the first round 14, the winners of the 1,000 flights will compete in the second round 16. Winners from flights one through ten of round one will be flight number one 14 in round two 16, winners from flights 11 through 20 of round one will be competitors in flight two of round two, etc. Therefore, round two 16 will consist of 100 flights of ten players each for a total of 1,000 contestants. After the second round is completed, the winners will compete in round three 18. Round three 18 will therefore consist of ten flights of ten players each. Flight one will consist of the winners of flights one through ten of round two, etc. Round four 20 is the final championship round and will consist of the ten winners from round three in a championship flight 24. Prizes 26 will be given to the top four finishers 28, places one through four, although this could vary from tournament to tournament. Consolation prizes, such as golf balls, may be given to the remaining entrants in the championship round.

A tournament 12 is configured to be completed in a specific time period. For example, a tournament will be completed within 60 minutes from the start based on the following exemplary tournament time allocations:

Four seconds per player input/output (for example, three-second player response and one second system response, i.e. number of strokes per hole calculation and display, and player selection).

Four minutes between rounds one and two, two and three, and three and four for a total of 12 minutes for resolution of ties and setting up the next round.

Four rounds of 18 holes each.

Therefore:

a) Four seconds/player/hole×ten players=40 seconds b) 18 holes×40 seconds=720 seconds=12 minutes/round c) Four rounds×12 minutes per round=48 minutes d) Three four-minute gaps between rounds=12 minutes e) Total 60 minutes [48+12, c) and d) above]

The above time allocation is typical and is shown as an example only. Other time allocations can be developed. For example, there may be an intermission after the first nine holes are played during which time advertisements may be displayed for the sponsers of the tournament.

The time selected for a tournament to start must accommodate different time zones. Therefore, for convenience, tournaments will typically be held in geographical areas comprising a single time zone to avoid confusion, however, more time zones, for example three, can be used. The three hour time zone primarily applies to the continental United States.

Tournaments can be held all over the world with proper site location. It is anticipated that tournaments will be held within the geographical boundaries of a particular country due to issues such as legality, politics, taxes, etc., although international competitions can be held by agreement. Europe is an example of a location for international competition, or an international tournament could be held with the winners of individual country tournaments with the site location selected by mutual agreement. For convenience, it is expected that tournaments will be held on a weekend (preferably Sunday). For example, a tournament can be held on a Sunday afternoon and, in the continental United States, 4 pm EST would be a typical starting time of a tournament, although other starting times can be used. For example if two tournaments are held on the same day at the same website, one could be held at 3 p.m. EST and the other at 5 p.m. EST. This would have the beneficial effect of doubling the weekly income.

In order to enter tournaments an individual will connect to a website running a registration subsystem from his/her home computer. The website will preferably be available 24 hours each day, Monday through Saturday. The contestant wil receive a message on his screen with instructions on registering as a user of the system in order to receive a user identification (club number) to be used in future tournament events. The information to be provided by the prospective contestant will include but not be limited to:

Name

Address

Telephone number (including area code)

Social Security number (if required for income tax purposes)

Credit card information (type, number and expiration date)

Certification of being at least 21 years old.

Upon credit card number validation and processing, a message is sent to the entrant's computer that the entrant's registartion has been accepted and a user club number is provided for use in future tournaments, or a message is returned to the entrant that his registration has not been accepted. Also, upon acceptance, the user's information is entered into a tournament library file.

To enter a specific tournament 12 as a contestant, a user will connect to a website running a tournament at which time he/she will either be informed that the tournament is filly subscribed and cannot accept any more contestants, or he/she will be asked to provide a user club number. Information related to the procedure to be followed on the date of the tournament will also be included in the message. The user's information will be retrieved from the tournament library file according to the user club number provided. The contestant is assigned a number and position within a flight 22. The flights 22, and positions within them, will be filled in order, i.e. flight one, position one, flight one, position two, etc. until all flights and positions are filled.

When the library is filled, an "all filled" message, or message to that effect, is activated on the message screen and no further entries are accepted. After the tournament, the winning positions are entered into the tournament library file. All file information is transferred to a history file and retained as a historical record of the tournament.

FIG. 2 shows the structure of the tournament library file 30. The file includes a tournament name 32, flight number 34, position within the flight 36, user identification number 38 and contestant information 40 which includes the information entered in the above-described registration.

Figure 3:
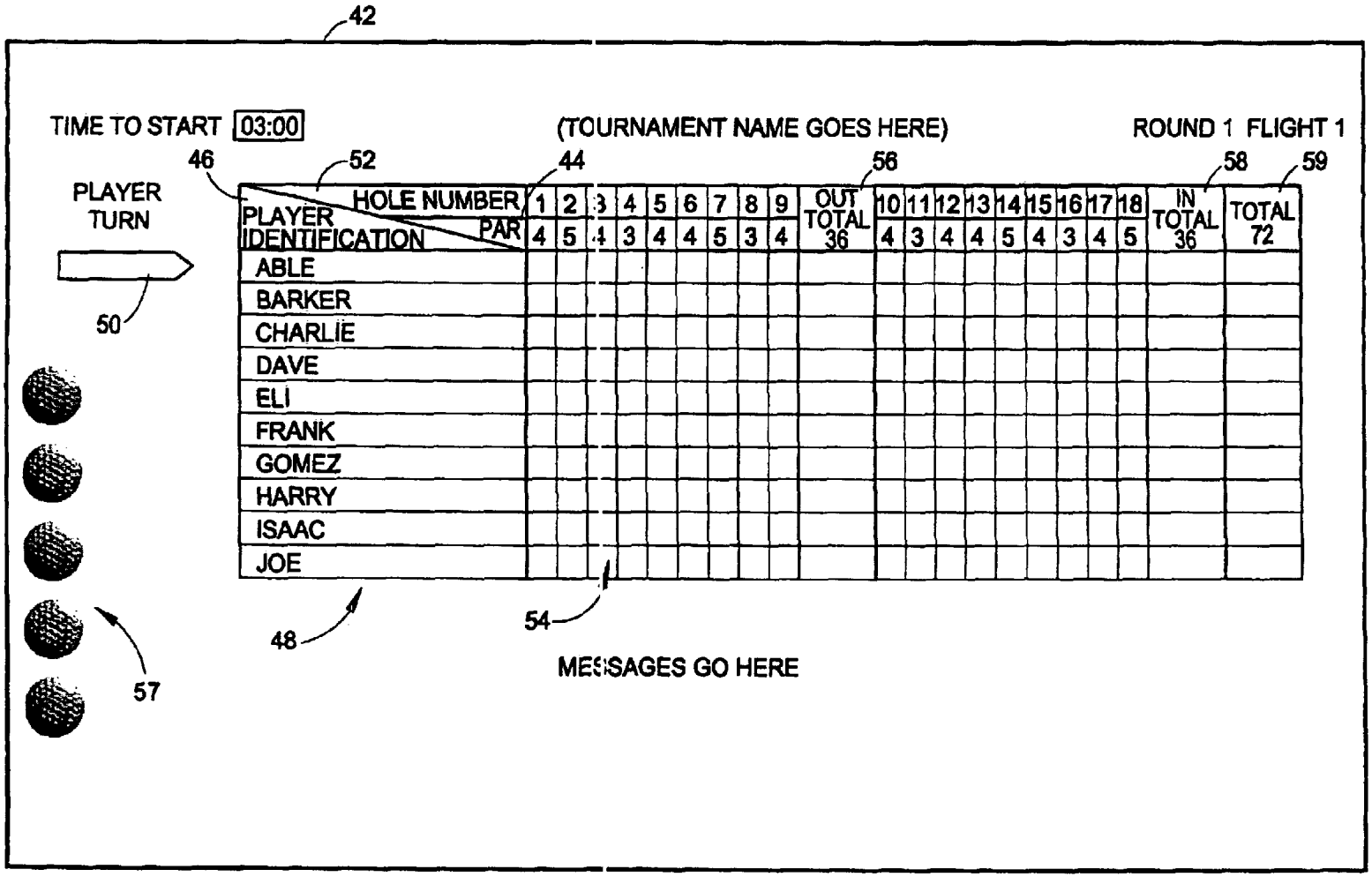
FIG. 3 is a tournament scorecard display format for all flights.

On the day of the tournament, each contestant must log in at least five minutes prior to the start of the tournament by providing the above-described user club number. Upon log-in, a set of simple tournament instructions will be displayed on the contestant's screen, the contestant's club number is automatically matched to the tournament library file and the number is verified that it exists in the file. Upon verification, the contestant is sent a display which is a flight scorecard along with a flight number and his name in one of the contestant slots. This is his/her position in the assigned flight 22. A representation of the display is shown in FIG. 3 and partially described here and further described below with respect to contestant messages and displays.

The display 42 shows the golf game layout 44 (i.e. par 3, 4 and 5 holes), the contestant's name 46, the contestant's position 48 in the round, and a cursor 50 which illuminates to indicate the player to play the hole. In a preferred embodiment, the possible scores (number of strokes) a player can receive are as follows: one through six for par 3 holes, two through seven for par 4 holes, and three through eight for par 5 holes.

This represents scores from an eagle through a triple bogie for any hole. This is a typical range of scores per hole, however, any numerical range can be used. The range selected represents realistic scores one can obtain on a golf course and minimizes the possibilities of ties in a flight. All displays available to a contestant are further described below.

At the start of a tournament, hole one in the hole number section 52 will be highlighted and the cursor 50 on the left of the first listed contestant (number one) will be illuminated. In one embodiment, contestant one has three seconds to depress the "enter" key on his/her computer keyboard. All other contestants, the remaining nine, are "locked out", i.e. if a contestant other than the one that has the illuminated cursor next to his/her name depresses the "enter" key on his/her computer keyboard, nothing will happen. If contestant number one depresses the enter key within three seconds, a signal is sent to a random number generator which selects a number based on the "par" value of the hole. This number is entered into a score totalizer for this contestant and the number is displayed on the screen for all flight contestants to observe in a score area 54. The score area 54 includes an out total 56 for the first nine holes, an in total 58 for the last none holes and an overall total 59 for all holes.

In an alternate embodiment, instead of the contestant having three seconds to depress the "enter" key, the system will display a number of golf balls (57), five for example, and each golf ball will correspond to a randomly generated number. The contestant will have three seconds to select a golf ball with a pointing device such as a mouse, and the number associated with that ball will be used in place of the random number described above. The three second time limit is arbitrary as previously described.

When the cursor illuminates next to contestant number two, contestant number two has three seconds to depress the enter key on his/her terminal keyboard, or select a golf ball, and the same process is repeated for contestant number two. The process is than repeated for contestants three to ten, and for the remaining 17 holes. Hole number two will be highlighted when this hole is played and the process will continue for the remaining holes. If a contestant does not depress the enter key, or select a golf ball, within three seconds after the cursor illuminates, that contestant is given the highest score possible for that hole (six for a par three hole, seven for a par four hole, and eight for a par five hole). In addition, if a person does not log in prior to the tournament, that person will forfeit the entrance fee and will receive the maximum score for each hole in the round.

At the completion of the first round, the scores of all the contestants will be totaled and displayed. The contestant with the lowest score will be highlighted and a message displayed with instructions for the next round. The display for all the losing contestants will be terminated and they will automatically be disconnected from the system.

If a tie occurs at the end of a round within a flight the scores of the tied players will be highlighted and their names retained on the scorecard. All other players will be eliminated along with all scores. A sudden death hole-by-hole process for the two or more finalists will commence at hole number one when the cursor illuminates next to the first player's name. The players depress the enter key to start the sudden death process. The player with the lowest score on the first hole will win the round. If a tie occurs on the first hole, the process will continue on hole number two until the tie is broken and a winner identified.

All flight winners will stay on line for the start of the second round. The system will automatically construct the second round flights by assigning the 1000 winners of the first round to the 100 flights of the second round. The second round will be played in the same manner as the first round. At the completion of the second round, the system will automatically construct the third round of flights by assigning the 100 winners of the second flight to the 10 flights of the third round. At the completion of the third round, the final championship round (fourth round) will be constructed automatically by the system by inserting the winners of the ten flights of the third round into the final score card. The final round is played in the same manner as rounds one, two and three. At the end of this round the first second, third and fourth place winners will be identified and the prizes distributed.

Messages and Displays

Various messages and displays are generated by the system before and during the tournament. These are shown in sequence from FIG. 4 through FIG. 13. When a contestant first connects to the website, he/she will receive a greeting message 60 as shown in FIG. 4 along with a description of the tournament procedures, the entry fee, and any other significant information. If the person wants to enter the tournament, he/she clicks on the "yes" box and the entrance instructions 62 appear as show in FIG. 5, or a message will appear that the tournament is fully booked and no other entries are being taken. The entrant inputs the information requested (club number) in the area provided and, if all information is validated as correct, a validation message 64 will be sent that the person has been entered into the tournament as shown in FIG. 6. At this point, a operational instruction message 66 is sent as shown in FIG. 7, which includes instructions to be followed on the date of the tournament.

When the contestant enters the website on the day of the tournament, a status message 68 is displayed as shown in FIG. 8. Once the instructions are followed, the scorecard related to the round one flight to which the contestant has been assigned (refer to FIG. 2) will appear on the player's screen. The scorecard format is shown in FIG. 3. Any round one messages will be included below the scorecard. Typical messages 70 are shown in FIG. 9.

The time remaining to the start of the tournament is shown by a countdown clock 72 in the upper left-hand corner in this example. When the clock reaches 00:00 minutes:seconds, the first player and hole number one will be illuminated and the player will have three seconds to press the "enter" key, or select a golf ball, to receive a score for the first hole 74 as shown in FIG. 10. When player number two illuminates, the same process is followed until the tournament is completed. A completed scorecard is shown in FIG. 11 along with a message for the winner 76 of the flight as shown in FIG. 12. The process continues for the remaining rounds. The championship round is shown in FIG. 13.

Functional Description and System Architecture

Figure 14:
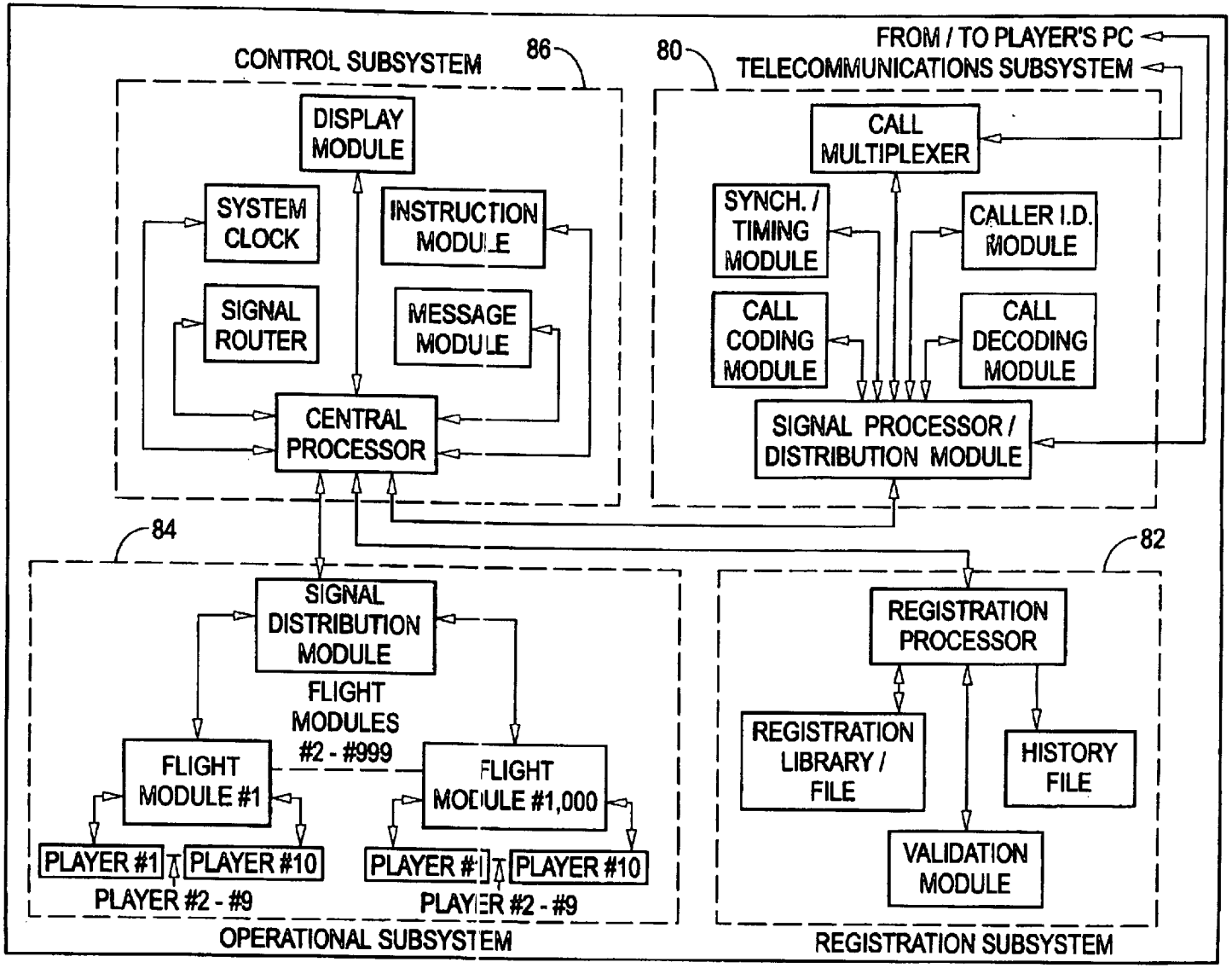
FIG. 14 is a golf tournament system block diagram.

As shown in FIG. 14, the Golf Tournament System consists of four main subsystems: the Telecommunication Subsystem 80, the Registration System 82, the Operational System 84 and the Control System 86. Top-level block diagrams of the Golf Tournament System subsystems are provided in FIG. 14.

The Telecommunication Subsystem 80 is the primary interface between the Golf Tournament System and the contestants. It is a high-speed signal multiplex/routing system that allows two way simultaneous communications between all 10,000 tournament players and the Golf Tournament System.

The Registration Subsystem 82 processes and validates contestant entry information. It establishes the Tournament Registration Library File (data format shown in FIG. 2), provides the interface between the System and the credit card billing module, and provides the basic structure for allocating the contestants to the flights for the first round. The contents of the Library file will be archived after the tournament for historical purposes.

Figure 15:
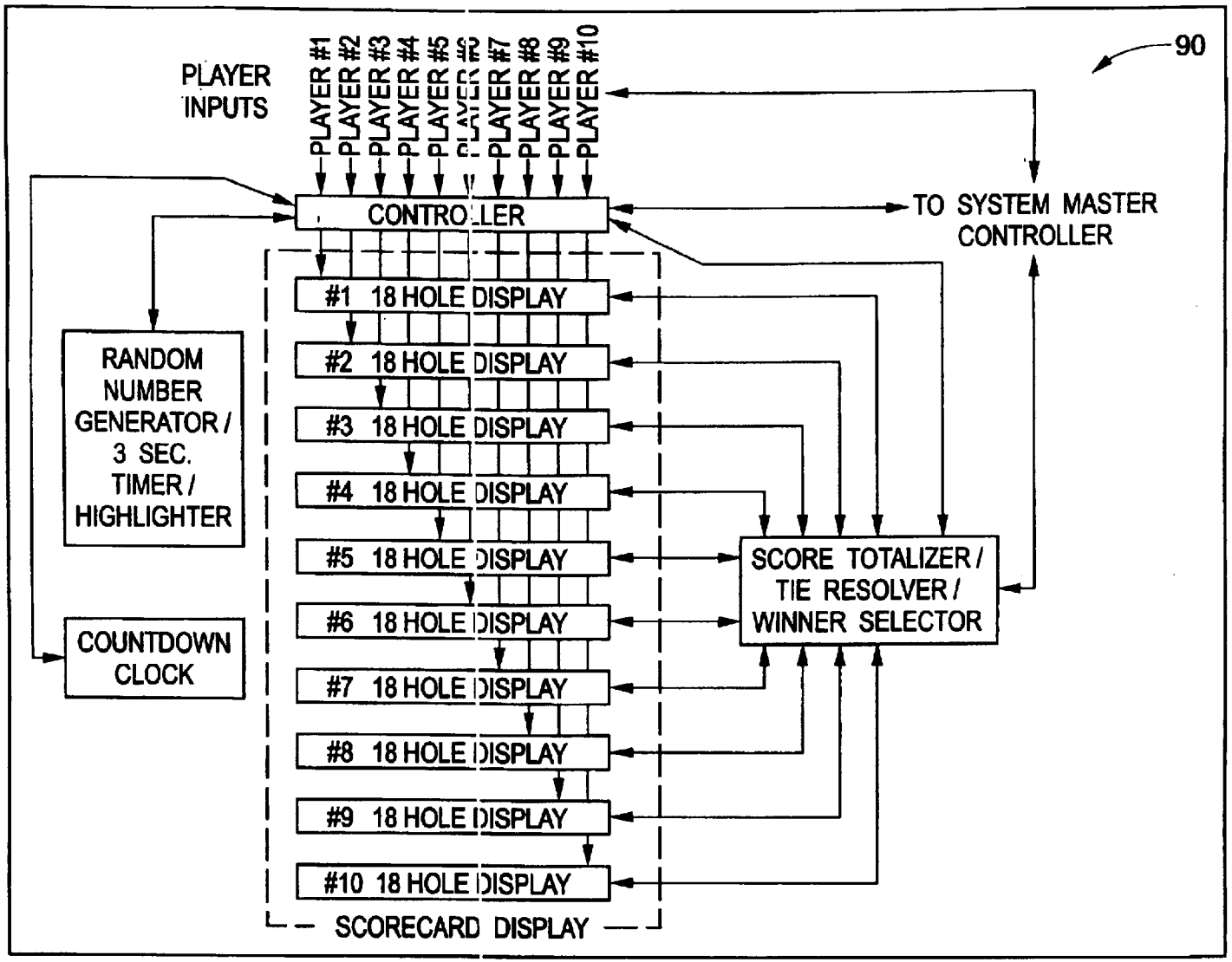
FIG. 15 is a representation of flight module configuration.
Figure 16A:
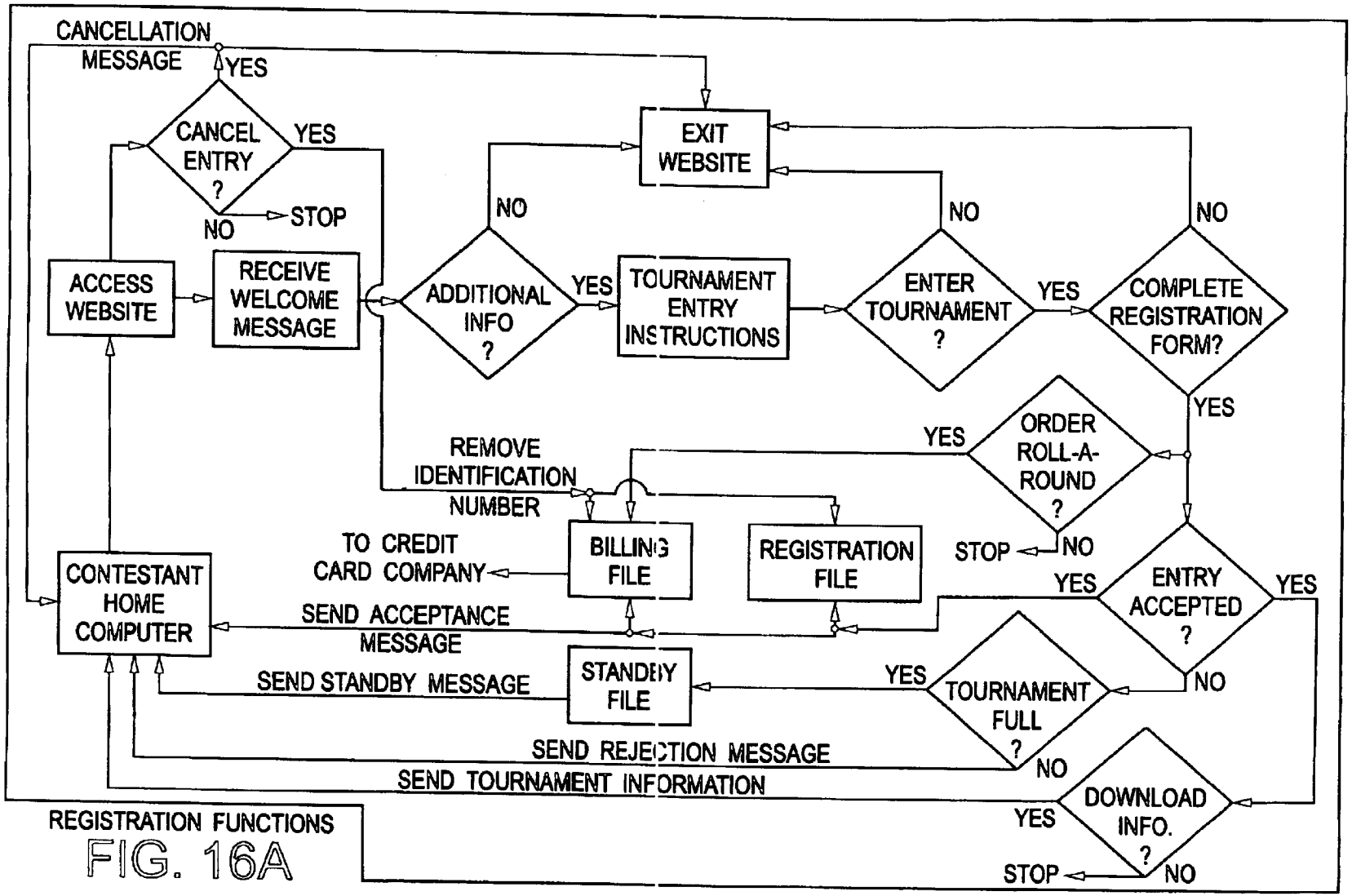
FIG. 16A is a flow diagram of registration functions.
Figure 16B:
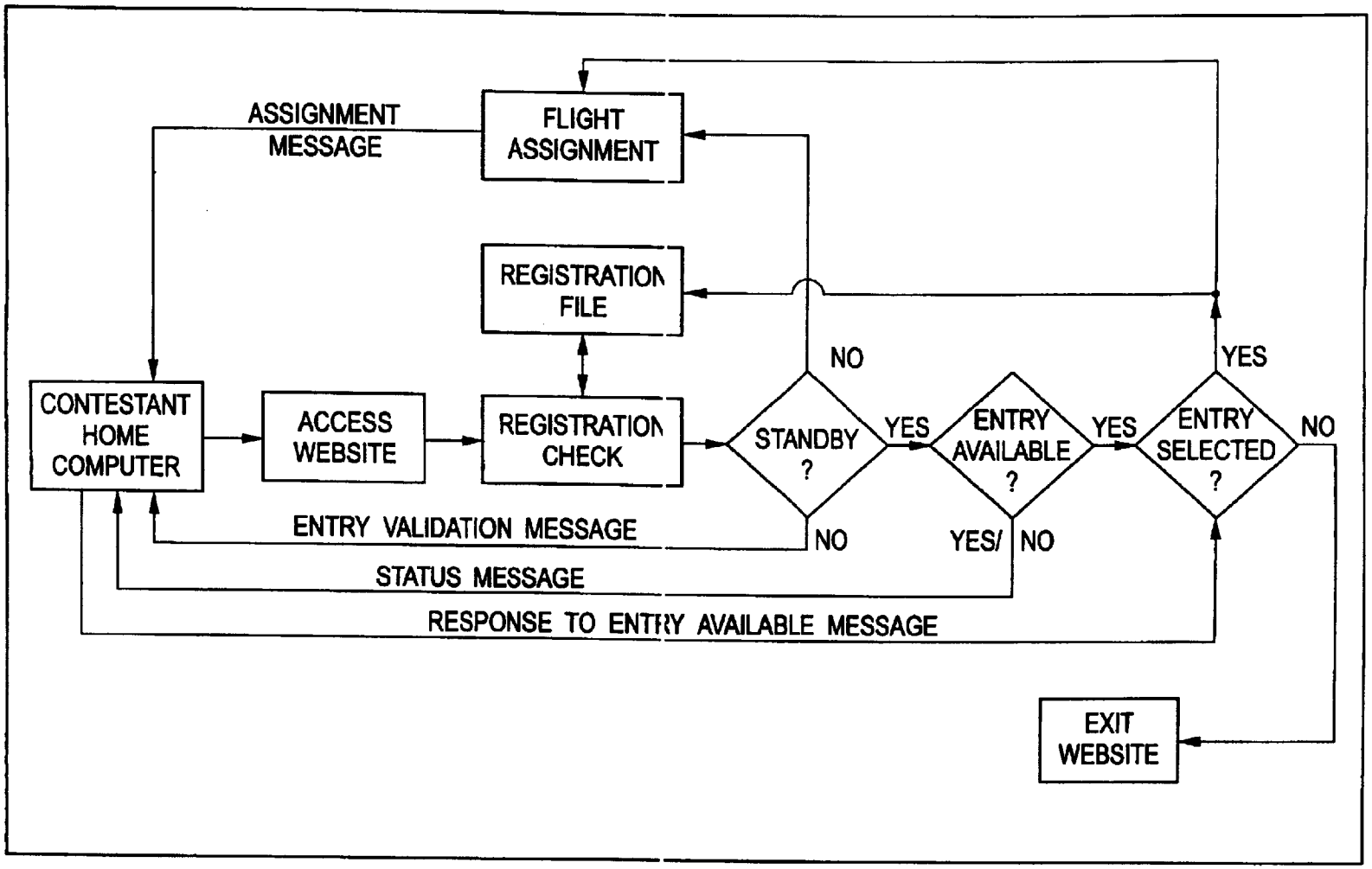
FIG. 16B is a flow diagram of status functions.
Figure 16C:
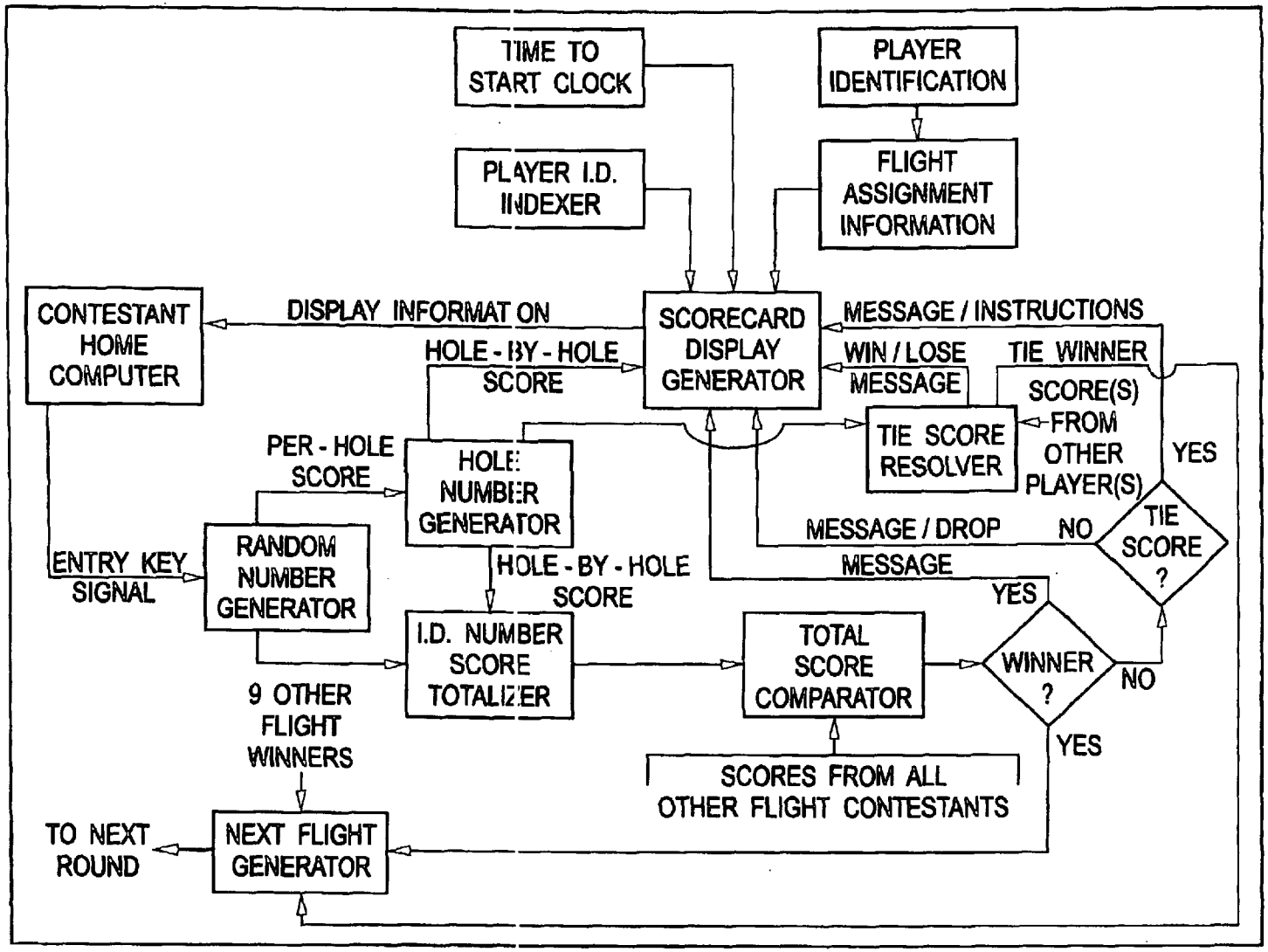
FIG. 16C is a flow diagram of tournament scoring functions.
Figure 16D:
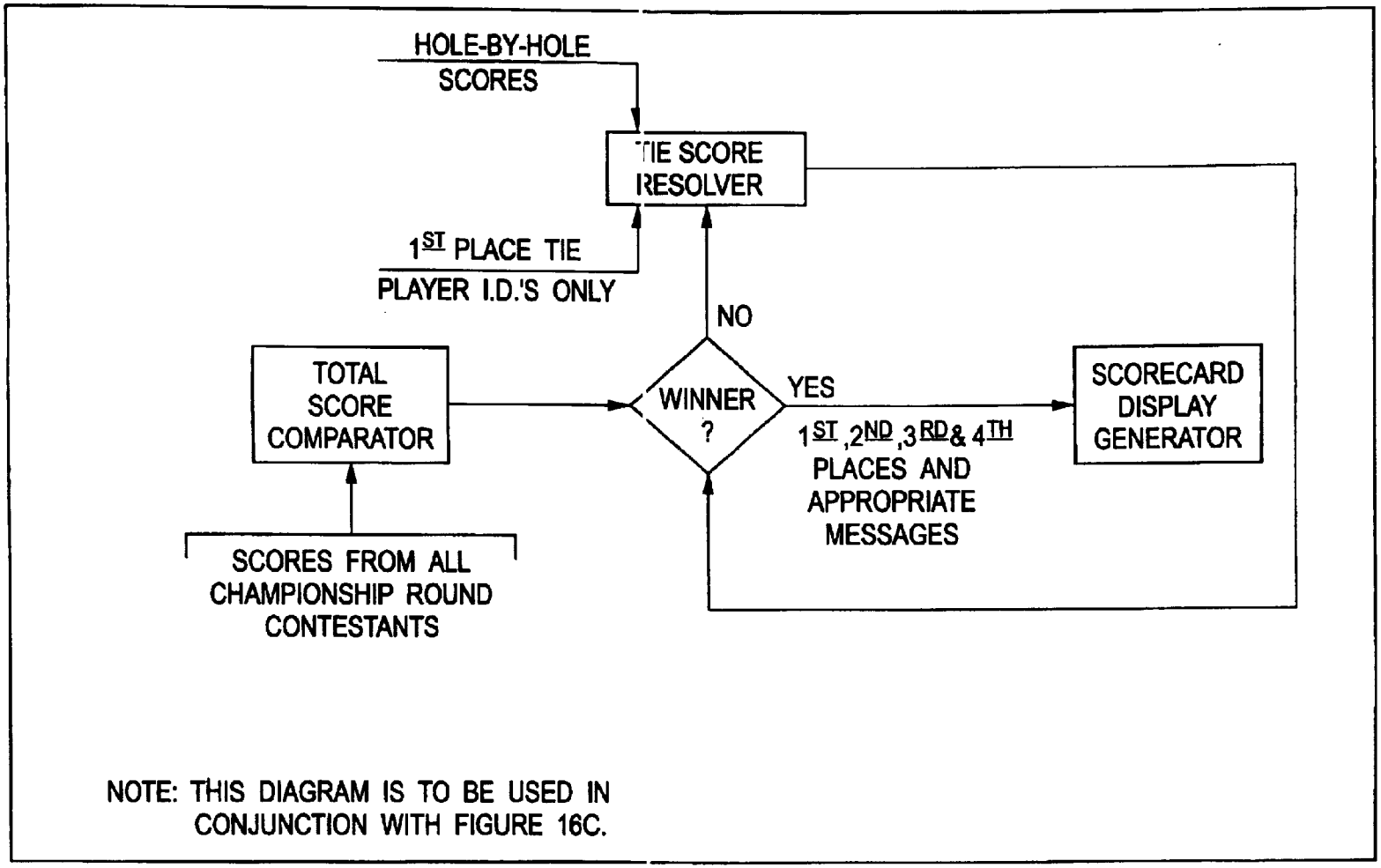
FIG. 16D is a flow diagram of championship round functions.

The Operational Subsystem 84 controls the game process for each round on a per-flight basis. Each flight has its own control module; there are 1,000 control modules 88 as shown in FIG. 1 and FIG. 2 in the total system to handle 10,000 players simultaneously. The flight control modules 88 process the contestant's inputs and activate the random number generators, produce the flight displays and determine the flight winners. The configuration of the Flight Module 90 is shown in FIG. 15.

The Control Subsystem 86 is the master controller or central processor of the system. It provides the interfaces between all subsystems and included modules and controls all game functions. Function diagrams related to system operation are shown in FIGS. 16A–D.

While the invention has been described with respect to specific embodiments by way of illustration, many modifications and changes will occur to those skilled in the art. It is therefore, to be understood that the appended claims are intended to cover all such modifications and changes which fall within the true spirit and scope of the invention.

What is claimed is:

1. A computer processed golf tournament system comprising:

(a) a control, subsystem configured to control a real time golf tournament game process wherein said game process comprises a plurality of rounds, wherein each round includes a plurality of flights;

(b) a plurality of control modules wherein each control module:
- (i) controls play of one of said flights;
- (ii) processes inputs of a contestant;
- (iii) generates a random number;
- (iv) produces a flight display; and
- (v) determines winners of one of said flights;

(c) a registration subsystem configured to register said contestants;

(d) a telecommunications subsystem configured to provide two way simultaneous communications between all of said contestants of said golf tournament system;

(e) an operational subsystem configured to control said game process for each of said rounds on a per-flight basis; and (f) a server computer system including at least one computer, wherein said computer system is connected to the Internet;

wherein said game process includes displaying a tournament scorecard screen comprising:

(g) a tournament name;

(h) a countdown clock;

(i) one or more contestant scores, each contestant score including:
- (i) contestant name;
- (ii) a plurality of hole scores having a respective hole number and par value;
- (iii) an out score total;
- (iii) an in score total; and
- (iii) an overall score total;

(j) a cursor; and (k) a message area; and wherein said tournament scorecard screen further comprises a plurality of blinking golf balls, wherein a contestant selects one of said blinking golf balls when said cursor points to said contestant name and one of said hole numbers is highlighted, wherein said selected golf ball has an associated random number for determining said contestant's score for said hole.

2. The computer processed golf tournament system of claim 1, wherein said contestant has a limited time for selecting one of said golf balls and, wherein said contestant is assigned a maximum score for said hole when no selection is made within said limited time.

3. The computer processed golf tournament system of claim 2, wherein said game process further includes:

(a) for each round except a last championship round:
- (i) determining a winner of each of said flights corresponding to said round based on said overall score of respective contestants; and
- (ii) assigning said flight winners of said flights to a new position in a new flight in a successive round; and (b) for said championship round:
- (i) determining one or more tournament winners of said championship round; and
- (ii) awarding prizes to said tournament winners based on respective overall scores of said championship round, wherein said championship round comprises one flight.

4. A method for playing an interactive computer processed golf tournament comprising the steps of:

(a) registering users via the Internet including:
- (i) receiving a user name, address, age, telephone and credit card data;
- (ii) verifying said age is at least 21 years;
- (iii) validating said user's credit card data;
- (iv) providing said validated user with a unique club number; and
- (v) storing said user name, address, age, telephone, credit card data and club number on a library file;

(b) scheduling named tournaments;

(c) registering users via the Internet as contestants in one of said named tournaments including:
- (i) receiving said user's club number;
- (ii) verifying said user club number;
- (iii) accepting said user as a contestant in said named tournament;
- (iv) assigning said user a position within a flight of a first round of said named tournament; and
- (v) storing said assigned position on said library file;

(d) receiving participating contestant logins via the Internet prior to said named tournament;

(e) providing said participating contestants with a scorecard display for said assigned flight including:
- (i) a tournament name;
- (ii) a countdown clock;
- (iii) one or more contestant scores, each contestant score including:
  - (a) contestant name;
  - (b) a plurality of hole scores having a respective hole number and par value;
  - (c) an out score total;
  - (d) an in score total; and
  - (e) an overall score total;
- (iv) a cursor; and
- (v) a message area;

(f) accepting in real time via the Internet from each of said participating contestants in turn for each of said holes an input determining a random score for said hole, including:
- (i) pointing said cursor at said participating contestant's score;
- (ii) highlighting a selected hole on said scorecard;
- (iii) displaying a plurality of blinking golf balls, wherein each golf ball is associated with a random number for determining said participant's score for said highlighted hole;
- (iv) providing a time limit for said participant to select one of said blinking golf balls; and
- (v) at least one of assigning a score based on a selected blinking golf ball and assigning a maximum score when said time limit expires;

(g) performing one of:
- (i) playing a round other than a championship round including:
  - (a) determining a winner of each of said flights based on a total of said random scores;
  - (b) assigning each of said winners to a position in a successive flight in a successive round; and
  - (c) repeating said step of accepting said inputs determining said random score; and
- (ii) playing a championship round including:
  - (a) determining a plurality of championship round winners based on said random scores; and
  - (b) awarding prizes to said championship round winners.

* * * * *